US006947000B2

(12) United States Patent
Ito

(10) Patent No.: US 6,947,000 B2
(45) Date of Patent: Sep. 20, 2005

(54) ANTENNA DEVICE AND PORTABLE RADIO COMMUNICATION DEVICE

(75) Inventor: Hiroki Ito, Tokyo (JP)

(73) Assignee: Sony Corporation, Tokyo (JP)

( * ) Notice: Subject to any disclaimer, the term of this patent is extended or adjusted under 35 U.S.C. 154(b) by 802 days.

(21) Appl. No.: 09/905,402

(22) Filed: Jul. 16, 2001

(65) Prior Publication Data

US 2002/0061734 A1 May 23, 2002

(30) Foreign Application Priority Data

Jul. 14, 2000 (JP) ..... P2000-215109
Dec. 27, 2000 (JP) ..... P2000-398777

(51) Int. Cl.[7] ..... H01Q 1/24
(52) U.S. Cl. ..... 343/702; 455/575.5
(58) Field of Search ..... 343/702; 379/451; 455/575.5

(56) References Cited

U.S. PATENT DOCUMENTS 6,615,026 B1 * 9/2003 Wong ..... 455/575.5
2001/0053673 A1 * 12/2001 Toyoda et al.
2001/0053677 A1 * 12/2001 Schiffer

FOREIGN PATENT DOCUMENTS

WO WO 94/21054 * 9/1994

* cited by examiner

*Primary Examiner*—Ahmad F. Matar
*Assistant Examiner*—Quynh H. Nguyen
(74) *Attorney, Agent, or Firm*—Jay H. Maioli

(57) ABSTRACT

Providing an antenna device and a portable radio communication device whose conductive plate for use in reducing the amount of the electromagnetic waves to be absorbed into a human body can be reduced in size. The portable radio communication device 1 includes a circuit board (not shown) necessary for performing radio communication, shield case 2 as a ground conductor which shields the circuit board, a conductive plate 3, an antenna feeding portion 4, and an antenna 5. The circuit board, shield case 2, and conductive plate 3 are enclosed by a housing (not shown) made of nonconductive material. The conductive plate 3 has its one end along the longitudinal direction connected to the shield case 2 to form a short circuit via the conductor 7, and has its other end electrically opened from the shield case 2. The conductive plate 3 has two slits 8*a*, 8*b* near the conductor 7.

12 Claims, 3 Drawing Sheets

ANTENNA DEVICE AND PORTABLE RADIO COMMUNICATION DEVICE

BACKGROUND OF THE INVENTION

1. Field of the Invention

The present invention relates to an antenna device and a portable radio communication device, and particularly to an antenna device and a portable radio communication device capable of reducing electromagnetic waves which are generated therefrom and are to be absorbed into a human body.

2. Description of Related Art

Recently, portable data transmitting/receiving devices capable of transmitting/receiving information by radio communication are significantly developed. Of the portable data transmitting/receiving devices, portable radio communication devices for use in the Cellular Telephone System and Personal Communication System etc. are spreading rapidly.

As the portable radio communication devices spread rapidly, the number of communication lines in one radio communication system becomes insufficient. So, a radio communication system which shares another frequency band with another radio communication system is being under consideration to secure necessary communication lines. Thus, as the portable radio communication devices have been significantly reduced in size and weight, portable radio communication devices which can utilize two kinds of radio communication systems are being developed.

Generally, a portable radio communication device has an antenna for transmitting/receiving signals. Actually, whole the conductive portions in the portable radio communication device work as antennas, and the main body of the portable radio communication device other than the antenna portion also generates electromagnetic waves. So, it is required that, of the electromagnetic waves generated from the portable radio communication device, those to be absorbed into a human body should be suppressed. Specifically, of the electromagnetic waves generated from the portable radio communication device in use, amount of electromagnetic waves to be absorbed into a specific portion of a human body (radiation to a human body), particularly a head portion, per unit-time per unit-weight is defined as local average SAR (Specific Absorption Rate), and the maximum value of the local average SAR is required to be not more than a prescribed value.

So as to reduce the maximum value of the local average SAR to be absorbed into a human body, a conductive plate of a predetermined shape may be used. In this case, the conductive plate has its one end connected to a ground conductor which works as an antenna to form a short circuit, and has its other end electrically opened from the ground conductor. As a result, input impedance of the electrically opened end becomes approximately infinite. At this time, high-frequency current flowing to the ground conductor is suppressed, and thus amount of radiation of the electromagnetic waves is reduced.

FIG. 1 shows a schematic view of a portable radio communication device 30, which can reduce the maximum value of the local average SAR. The portable radio communication device 30 includes a circuit board (not shown) necessary for performing radio communication, a shield case 31 as a ground conductor which shields the circuit board, a conductive plate 32, an antenna feeding portion 33, and an antenna 34. The circuit board, shield case 31, and conductive plate 32 are enclosed by a housing (not shown) made of nonconductive material. The conductive plate 32 and shield case 31 are connected by a conductor 35 to form a short circuit.

Since the circuit board is shielded by the shield case 31, various circuits including a transmitting/receiving circuit for communicating with a base station which are mounted on the circuit board do not have bad effects upon. each other, and also do not have bad effects upon the antenna 34 and other devices.

The transmitting/receiving circuit on the circuit board in the shield case 31 generates transmission signals of a predetermined signal form, and sends the transmission signals to the antenna 34 via the antenna feeding portion 33. Then, the antenna 34 transmits the transmission signals to the base station. The antenna 34 receives reception signals from the base station, and sends the reception signals to the transmitting/receiving circuit via the antenna feeding portion 33. Then, the transmitting/receiving circuit performs processing for the reception signals such as demodulating.

The antenna 34 is a rod antenna made of conductive wire materials, or a helical antenna made of conductive wire materials wound spirally. Otherwise, the antenna 34 may be an antenna of various types such as a stretch type antenna combining the rod antenna and helical antenna. When the portable radio communication device 30 performs radio communication, since the high-frequency current flows to the shield case 31 via the antenna feeding portion 33, not only the antenna 34 but also the shield case 31 as a ground conductor for the circuit board works as an antenna. That is, whole the portable radio communication device 30 works as an antenna.

When the portable radio communication device 30 is used, the user comes into contact with a speaker of the portable radio communication device 30. Since the shield case 31 as a ground conductor for the circuit board which is located behind the speaker also works as an antenna and radiates electromagnetic waves, there will be formed a portion where the value of the local average SAR becomes maximum around an ear of the user which comes into contact with the speaker, and this portion will be referred to as a hot spot.

The portable radio communication device 30 has the conductive plate 32 arranged such that the speaker (not shown) faces the conductive plate 32, and the conductive plate 32 and a front surface 31*a* of the shield case 31 are approximately parallel with each other with a slight interval therebetween. The interval between the conductive plate 32 and the front surface 31*a* of the shield case 31 depends on a radio communication frequency, and the portable radio communication device 30 can adjust the frequency bandwidth in accordance with the interval.

The conductive plate 32 has its one end along the longitudinal direction connected to the shield case 31 to form a short circuit via the conductor 35, and has its other end electrically opened from the shield case 31. The length $L_5$ between the short circuit forming end and the electrically opened end is set to be a quarter of the wavelength of the radio communication frequency.

Accordingly, the impedance between the conductive plate 32 and the shield case 31 becomes close to zero at the short circuit forming end, while becoming approximately infinite at the electrically opened end. Thus, the high-frequency current has difficulty in flowing from the antenna feeding portion 33 to the conductive plate 32 and the shield case 31.

As has been described, as an example to reduce the maximum value of the local average SAR to be absorbed into a human body, the portable radio communication device 30 mounts a conductive plate 32 thereto, and reduces the amount of radiation of the electromagnetic waves from the conductive plate 32 and shield case 31. Thus, the local average SAR at the hot spot can be reduced.

However, in the portable radio communication device 30, since the length $L_5$ between the short circuit forming end and the electrically opened end of the conductive plate 32 depends on the radio communication frequency in use, the length $L_5$ may be too large, which prevents a liquid crystal display or a keypad for operation from being appropriately arranged on a front surface of the portable radio communication device 30.

SUMMARY OF THE INVENTION

It is therefore an object of the present invention to overcome the above-mentioned drawbacks by providing an antenna device and a portable radio communication device whose conductive plate for use in reducing the amount of the electromagnetic waves to be absorbed into a human body can be reduced in size.

According to the present invention, there is provided an antenna device having an antenna element and a ground conductor which work as an antenna, in which the antenna element is fed via an antenna feeding portion and high-frequency current flows to the ground conductor via the antenna feeding portion, the antenna device comprising:

high-frequency current suppressing means being a conductive plate of a predetermined shape which has its one end along one direction connected to the ground conductor to form a short circuit and has its other end electrically opened from the ground conductor, wherein the high-frequency current suppressing means has slits each extends perpendicular to the one direction.

In the antenna device, the slits make the effective length of the conductive plate ((2n+1)/4) times the wavelength of a radio communication frequency, wherein n is a natural number including zero.

These objects and other objects, features and advantages of the present invention will become more apparent from the following detailed description of the preferred embodiments of the present invention when taken in conjunction with the accompanying drawings.

DESCRIPTION OF THE PREFERRED EMBODIMENTS

The portable radio communication device according to the present invention has mounted thereto a conductive plate of a predetermined shape at a predetermined position. Thus, even though either of radio communication frequencies is used by the portable radio communication device in a radio communication system in which two or more different radio communication frequencies can be used, of the electromagnetic waves generated from the portable radio communication device, the maximum value of the local average SAR (Specific Absorption Rate) to be absorbed into a specific portion of a human body (radiation to a human body) can be reduced.

Figure 1:
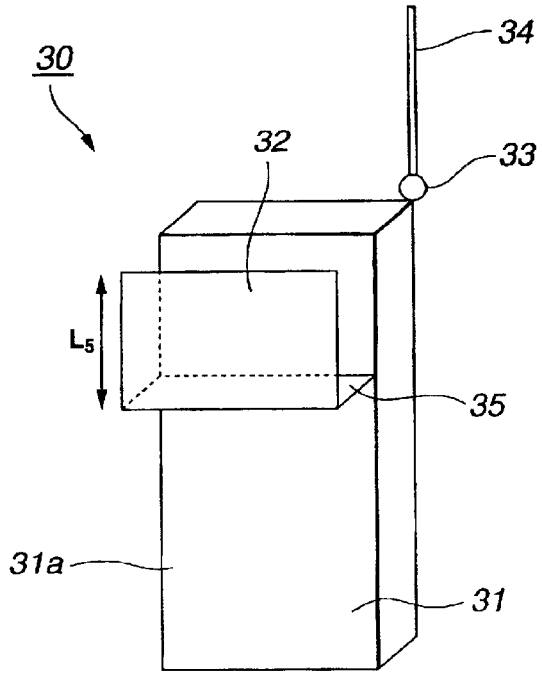
FIG. 1 shows a schematic view of a conductive plate mounted to the conventional portable radio communication device.
Figure 2:
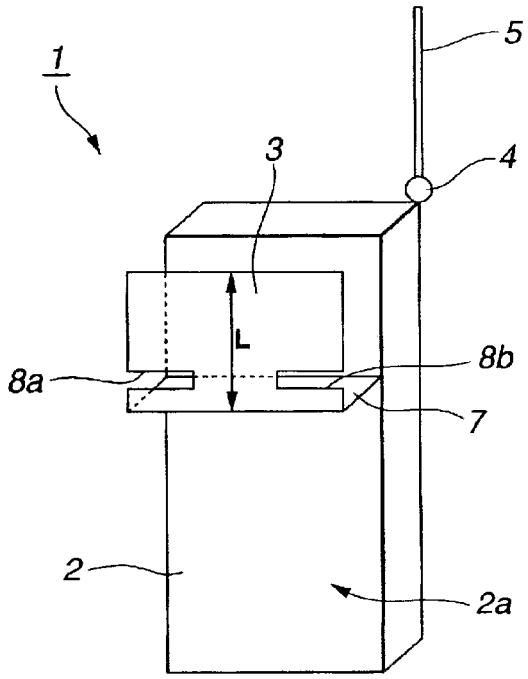
FIG. 2 shows a schematic view of a conductive plate mounted to a first embodiment of the portable radio communication device according to the present invention.

Preferred embodiments according to the present invention will further be described below with reference to the accompanying drawings. FIG. 2 shows a schematic view of a first embodiment of a portable radio communication device 1 according to the present invention, whose conductive plate can be reduced in size by forming slits on the conductive plate.

The portable radio communication device 1 includes a circuit board (not shown) necessary for performing radio communication, shield case 2 as a ground conductor which shields the circuit board, a conductive plate 3, an antenna feeding portion 4, and an antenna 5. The circuit board, shield case 2, and conductive plate 3 are enclosed by a housing (not shown) made of nonconductive material.

Since the circuit board is shielded by the shield case 2, various circuits including a transmitting/receiving circuit for communicating with a base station which are mounted on the circuit board do not have bad effects upon each other, and also do not have bad effects upon the antenna 5 and other devices.

The transmitting/receiving circuit on the circuit board in the shield case 2 generates transmission signals of a predetermined signal form, and sends the transmission signals to the antenna 5 via the antenna feeding portion 4. Then, the antenna 5 transmits the transmission signals to the base station. The antenna 5 receives reception signals from the base station, and sends the reception signals to the transmitting/receiving circuit via the antenna feeding portion 4. Then, the transmitting/receiving circuit performs processing for the reception signals such as demodulating.

The antenna 5 is a rod antenna made of conductive wire materials. When the portable radio communication device 1 performs radio communication, since the high-frequency current flows to the shield case 2 via the antenna feeding portion 4, not only the antenna 5 but also the shield case 2 as a ground conductor for the circuit board works as an antenna. That is, whole the portable radio communication device 1 works as an antenna. So, the main body of the portable radio communication device 1 other than the antenna 5 portion generates electromagnetic waves. So, it is required that electromagnetic waves to be absorbed into a human body should be suppressed. Specifically, of the electromagnetic waves generated from the portable radio communication device 1, amount of electromagnetic waves to be absorbed into a specific portion of a human body (radiation to a human body), particularly a head portion, per unit-time per unit-weight is defined as local average SAR (Specific Absorption Rate), and the maximum value of the local average SAR is required to be not more than a prescribed value.

Figure 3:
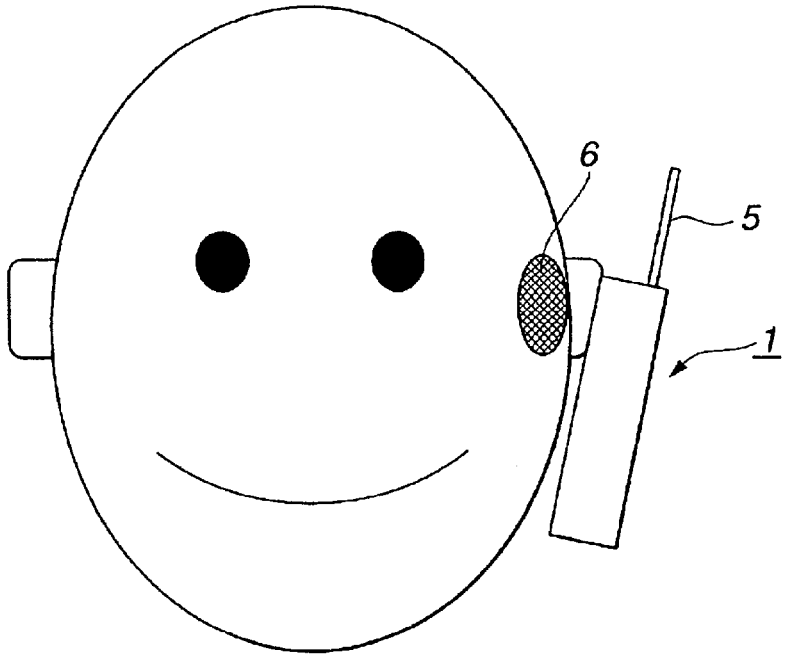
FIG. 3 shows a schematic view of a portion where the value of the local average SAR of the electromagnetic waves generated from the first, second, and third embodiments of the portable radio communication device according to the present invention in use becomes maximum.

When the portable radio communication device 1 is used, the user comes into contact with a speaker, not shown, of the portable radio communication device 1, as schematically shown in FIG. 3. Since the shield case 2 as a ground conductor for the circuit board which is located behind the speaker also works as an antenna and radiates electromagnetic waves, there will be formed a portion where the value of the local average SAR becomes maximum around an ear of the user which comes into contact with the speaker, and this portion will be referred to as a hot spot 6.

So as to effectively reduce the maximum value of the local average SAR at the hot spot 6, the portable radio communication device 1 has the conductive plate 3 arranged such that the speaker (not shown) faces the conductive plate 3, and the conductive plate 3 and a front surface 2*a* of the shield case 2 are approximately parallel with each other with an appropriate interval-therebetween, as shown in FIG. 2. The interval between the conductive plate 3 and the front surface 2*a* of the shield case 2 depends on a radio communication frequency, and the portable radio communication device 1 can adjust the interval in accordance with the frequency bandwidth. The conductive plate 3 has its one end along the longitudinal direction connected to the shield case 2 to form a short circuit via the conductor 7, and has its other end electrically opened from the shield case 2. The conductive plate 3 has two slits 8*a*, 8*b* near the conductor 7.

Accordingly, the impedance between the shield case 2 and the conductive plate 3 becomes approximately infinite at the electrically opened end, while becoming close to zero at the short circuit forming end. Under this condition, the maximum value of the local average SAR at the hot spot 6 can effectively be reduced. That is, since the impedance between the shield case 2 and the conductive plate 3 gradually increases from the short circuit forming end to the electrically opened end, the high-frequency current corresponding to the radio communication frequency has difficulty in flowing in the shield case 2. So, the amount of radiation of the electromagnetic waves from the shield case 2 is reduced. Thus, the maximum value of the local average SAR at the hot spot 6 can be reduced.

In the portable radio communication device 1, the slits 8*a*, 8*b* of any shape can be used as long as the effective length of the conductive plate 3 becomes ((2n+1)/4) times the wavelength of the radio communication frequency, wherein the "n" is a natural number including zero. That is, the effective length of the conductive plate 3 is an odd multiple of a quarter of the wavelength of the radio communication frequency.

Next, specific values of the local average SAR obtained from an examination will be shown, in which the conductive plate 3 has its one end along the longitudinal direction connected to the shield case 2 via the conductor 7 such that the interval between the conductive plate 3 and the front surface 2*a* of the shield case 2 becomes 5 mm, and slits of 1 mm in width and 11 mm in depth are formed on the conductive plate 3, and radio communication frequency of 1.8 GHz is used. Table 1 shows the result of the values of the local average SAR obtained from the examination.

TABLE 1

| | short circuit forming end - electrically opened end | reduction rate of SAR |
|---|---|---|
| slits not formed | λ/6 | 0% |
| | λ/4 | 25% |
| slits formed | λ/6 | 15% |

In Table 1, "λ" is a wavelength. Firstly, the result when the slits are not formed on the conductive plate 3 is shown. As shown in Table 1, in case the length L between the short circuit forming end and the electrically opened end is λ/6, the reduction rate of the local average SAR is 0%, which value is insufficient to reduce the local average SAR as compared with the case in which the conductive plate 3 is not arranged. In case the length L is λ/4, the reduction rate of the local average SAR is 25%. Secondly, the result when the slits are formed on the conductive plate 3 is shown. In case the length L is λ/6, the reduction rate of the local average SAR is 15%. As is apparent from the result, in case the slits are not formed, there is no effect of reducing the local average SAR when the length L is λ/6. On the, other hand, in case the slits are formed, there arises effect of reducing the local average SAR even though the length L is λ/6.

Thus, by forming slits of a predetermined shape on the conductive plate 3, even though the length L between the short circuit forming end and the electrically opened end is less than a quarter of the wavelength of the radio communication frequency, the resulting effect can be similar to that of a case in which the length L between the short circuit forming end and the electrically opened end is a quarter of the wavelength of the radio communication frequency. Thus, in reducing the portable radio communication device 1 in size, forming slits on the conductive plate 3 is very effective.

Figure 4:
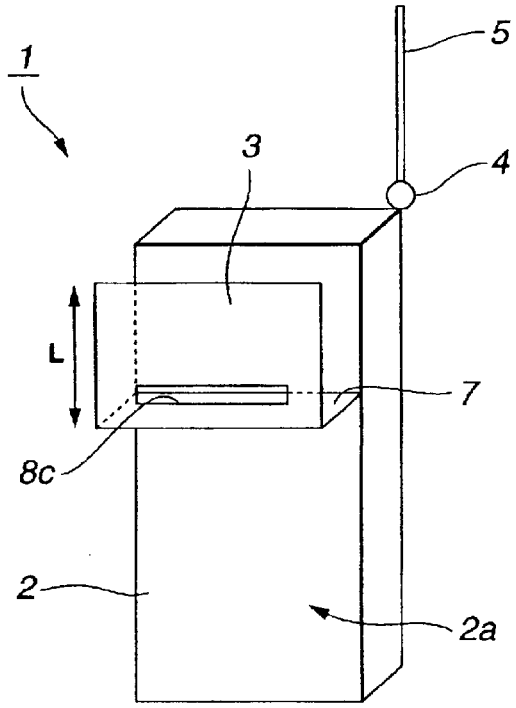
FIG. 4 shows a schematic view of a conductive plate mounted to the first embodiment of the portable radio communication device according to the present invention.

On the other hand, as shown in FIG. 4, the conductive plate 3 may have an opening slit 8*c*. At this time, similar to the above-described slits 8*a*, 8*b*, the opening slit 8*c* of any shape can be used as long as the effective length of the conductive plate 3 becomes ((2n+1)/4) times the wavelength of the radio communication frequency, wherein the "n" is a natural number including zero.

Figure 5:
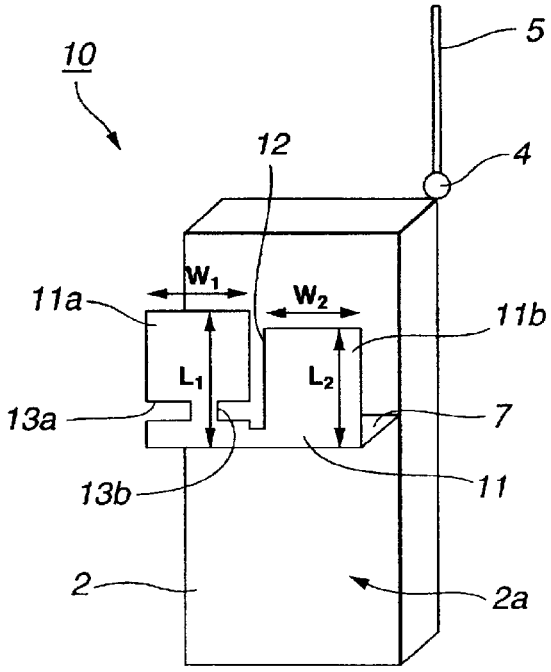
FIG. 5 shows a schematic view of a conductive plate mounted to a second embodiment of the portable radio communication device according to the present invention.

FIG. 5 shows a schematic view of a second embodiment of a portable radio communication device 10 according to the present invention. The fundamental configuration of the portable radio communication device 10 is similar to that of the portable radio communication device 1, so the parts or components similar to those of the portable radio communication device 1 shown in FIG. 2 are indicated with the same reference numerals, and detailed description will be omitted.

In the second embodiment, even though either of radio communication frequencies is used by the portable radio communication device 10 in a radio communication system in which two or more different radio communication frequencies can be used, of the electromagnetic waves generated from the portable radio communication device 10, the maximum value of the local average SAR (Specific Absorption Rate) to be absorbed into a specific portion of a human body (radiation to a human body) can be reduced. The portable radio communication device 10 has a conductive plate 11 which can cope with two different radio communication frequencies.

The conductive plate 11 also has its one end along the longitudinal direction connected to the shield case 2 to form a short circuit via the conductor 7, and has its other end electrically opened from the shield case 2. The conductive plate 11 has a slit 12 which is formed by cutting off a part of the conductive plate 11 from the electrically opened end and slits 13*a*, 13*b* near the conductor 7. That is, the conductive plate 11 has two plate portions 11*a*, 11*b* combined near the conductor 7, one of which is of a length of $L_1$ and of a width of $W_1$, and the other of which is of a length of $L_2$ and of a width of $W_2$. In other words, the slit 12 separates the conductive plate 11 to form the two plate portions 11*a*, 11*b*.

As is apparent from the first embodiment, by forming the slits 13*a*, 13*b* on the conductive plate 11, the actual length of the conductive plate 11 can be less than a quarter of the wavelength of the radio communication frequency, while the effective length of the conductive plate 11 being a quarter of the wavelength of the radio communication frequency. That is, the $L_2$ between the short circuit forming end and the electrically opened end of the plate portion 11*b* is a quarter of the wavelength λ2 of the second radio communication frequency of 1.8 GHz. On the other hand, since the slits 13*a*, 13*b* are formed, the $L_1$ between the short circuit forming end and the electrically opened end of the plate portion 11*a* is less than a quarter of the wavelength λ1 of the first radio communication frequency of 900 MHz.

Thus, by forming slits of a predetermined shape on the conductive plate 11, the length between the short circuit forming end and the electrically opened end can be less than a quarter of the wavelength of the radio communication frequency. So, in reducing the portable radio communication device 10 in size, forming slits on the conductive plate 11 is very effective. On the other hand, the conductive plate 11 may have an opening slit shown in FIG. 4 instead of having the slits.

Figure 6:
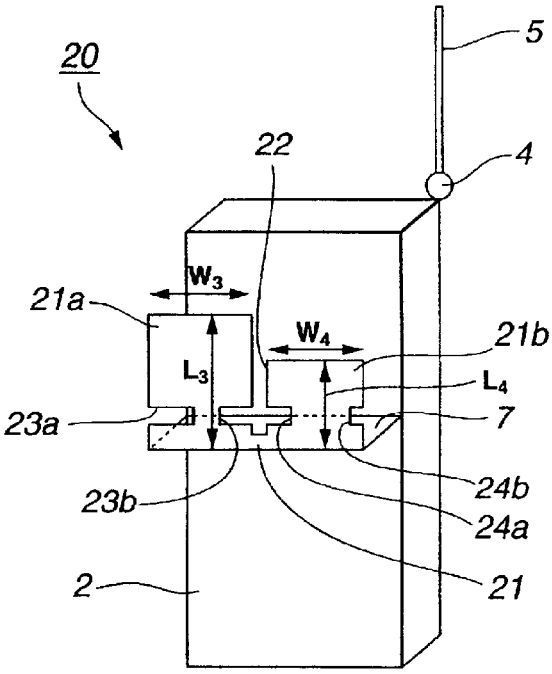
FIG. 6 shows a schematic view of a conductive plate mounted to a third embodiment of the portable radio communication device according to the present invention.

FIG. 6 shows a schematic view of a third embodiment of a portable radio communication device 20 according to the present invention. The fundamental configuration of the portable radio communication device 20 is similar to that of the portable radio communication device 1, so the parts or components similar to those of the portable radio communication device 1 shown in FIG. 2 are indicated with the same reference numerals, and detailed description will be omitted.

In the third embodiment, even though either of radio communication frequencies is used by the portable radio communication device 20 in a radio communication system in which two or more different radio communication frequencies can be used, of the electromagnetic waves generated from the portable radio communication device 20, the maximum value of the local average SAR (Specific Absorption Rate) to be absorbed into a specific portion of a human body (radiation to a human body) can be reduced. The portable radio communication device 20 has a conductive plate 21 which can cope with two different radio communication frequencies.

The conductive plate 21 also has its one end along the longitudinal direction connected to the shield case 2 to form a short circuit via the conductor 7, and has its other end electrically opened from the shield case 2. The conductive plate 21 has a slit 22 which is formed by cutting off a part of the conductive plate 21 from the electrically opened end and slits 23*a*, 23*b*, 24*a*, and 24*b* near the conductor 7. That is, the conductive plate 11 has two plate portions 21*a*, 21*b* combined near the conductor 7, one of which is of a length of $L_3$ and of a width of $W_3$, and the other of which is of a length of $L_4$ and of a width of $W_4$. In other words, the slit 22 separates the conductive plate 21 to form the two plate portions 21*a*, 21*b*.

As is apparent from the first embodiment, by forming the slits 23*a*, 23*b*, 24*a*, and 24*b* on the conductive plate 11, the actual length of the conductive plate 21 can be less than a quarter of the wavelength of the radio communication frequency, while the effective length of the conductive plate 21 being a quarter of the wavelength of the radio communication frequency. That is, since the slits 23*a*, 23*b* are formed, the $L_3$ between the short circuit forming end and the electrically opened end of the plate portion 21*a* is less than a quarter of the wavelength λ1 of the first radio communication frequency of 900 MHz. Similarly, since the slits 24*a*, 24*b* are formed, the $L_4$ between the short circuit forming end and the electrically opened end of the plate portion 21*b* is less than a quarter of the wavelength λ2 of the second radio communication frequency of 1.8 GHz.

Thus, by forming slits of a predetermined shape on the conductive plate 21, the length between the short circuit forming end and the electrically opened end can be less than a quarter of the wavelength of the radio communication frequency. So, in reducing the portable radio communication device 20 in size, forming slits on the conductive plate 21 is very effective. On the other hand, the conductive plate 21 may have an opening slit shown in FIG. 4 instead of having the slits.

As has been described above, by employing the conductive plate 11 shown in the second embodiment and the conductive plate 21 shown in the third embodiment, even though either of radio communication frequencies is used by the portable radio communication device in a radio communication system in which two different radio communication frequencies can be used, of the electromagnetic waves generated from the portable radio communication device, the maximum value of the local average SAR can be reduced.

In the first, second and third embodiments according to the present invention, the slits of any shape can be used as long as the effective length of the conductive plate becomes ((2n+1)/4) times the wavelength of the radio communication frequency, wherein the "n" is a natural number including zero. That is, the effective length of the conductive plate is an odd multiple of a quarter of the wavelength of the radio communication frequency. So, the positions, depths and widths of the slits are not restricted to those shown in FIGS. 2, 3, and 4.

The present invention is not to restricted to the above described embodiments, and various modifications can be possible without departing from the spirit and scope of the present invention.

What is claimed is:

1. An antenna device having an antenna element and a ground conductor working as an antenna wherein the antenna element is fed via an antenna feeding portion, and a high-frequency current flows to the ground conductor via the antenna feeding portion, the antenna device comprising:

high-frequency current suppressing means formed of a conductive plate of a predetermined shape having one end along one direction connected to the ground conductor to form a short circuit and having an other end electrically opened from the ground conductor, wherein the high-frequency current suppressing means has slits extending perpendicular to the one direction, and wherein the slits make the effective length of the conductive plate ((2n+1)/4) times a wavelength of a radio communication frequency, n being a natural number including zero.

2. The antenna device as set forth in claim 1, wherein each of the slits is formed by cutting off a part of the conductive plate from a side to a center thereof.

3. The antenna device as set forth in claim 1, wherein the slits form an opening slit formed by cutting off a part of the conductive plate at a predetermined position thereof.

4. The antenna device as set forth in claim 1, wherein the high-frequency current suppressing means includes a first conductive plate corresponding to one radio communication frequency and a second conductive plate corresponding to an other radio communication frequency.

5. The antenna device as set forth in claim 4, wherein the first conductive plate has slits each formed by cutting off a part of the first conductive plate from a side to a center thereof.

6. The antenna device as set forth in claim 1, wherein the high-frequency current suppressing means is arranged to face a portion of the ground conductor wherein electromagnetic waves generated when the high-frequency current flows to the ground conductor and to be absorbed by a human body are maximum.

7. A portable radio communication device including an antenna device having an antenna element and a ground conductor working as an antenna wherein the antenna element is fed via an antenna feeding portion, and a high-frequency current flows to the ground conductor via the antenna feeding portion, wherein a circuit board for transmitting/receiving signals is shielded by the ground conductor, and the antenna device comprises:

high-frequency current suppressing means formed of a conductive plate of a predetermined shape having one end along one direction connected to the ground conductor to form a short circuit and having an other end electrically opened from the ground conductor, wherein the high-frequency current suppressing means has slits extending perpendicular to the one direction, and wherein the slits make the effective length of the conductive plate ((2n+1)/4) times a wavelength of a radio communication frequency, n being a natural number including zero.

8. The portable radio communication device as set forth in claim 7, wherein each of the slits is formed by cutting off a part of the conductive plate from a side to a center thereof.

9. The portable radio communication device as set forth in claim 7, wherein the slits form an opening slit formed by cutting off a part of the conductive plate at a predetermined position thereof.

10. The portable radio communication device as set forth in claim 8, wherein the high-frequency current suppressing means includes a first conductive plate corresponding to one radio communication frequency and a second conductive plate corresponding to an other radio communication frequency.

11. The portable radio communication device as set forth in claim 10, wherein the first conductive plate has slits each formed by cutting off a part of the first conductive plate from a side to a center thereof.

12. The portable radio communication device as set forth in claim 7, wherein the high-frequency current suppressing means is arranged to face a portion of the ground conductor wherein electromagnetic waves generated when the high-frequency current flows to the ground conductor and to be absorbed by a human body are maximum.

* * * * *